COMBINED LIFTING EYE AND FLYWHEEL HOUSING OPENING COVER

BACKGROUND OF THE INVENTION

This invention relates to internal combustion engines, and more specifically, to a combined lifting eye and flywheel timing opening cover.

Most multiple cylinder engines in use today include blocks mounting one or more lifting eyes whereby the engine can be lifted from a support such as the frame of a vehicle to facilitate major servicing of the components. In many cases, peripheral equipment associated with the engine demands that the lifting eye or eyes be located asymmetrically with respect to the longitudinal axis of the engine thereby causing the engine to tend to skew relative to its support when moved towards or away therefrom. Such skewing makes it difficult to remove an engine from cramped quarters in an engine compartment and/or align the engine with motor mounts and transmission components when introducing the engine into an engine compartment or the like.

Moreover, many lifting eyes are secured directly to the engine block with the consequence that the eye or opening in the lifting eye is relatively inaccessible in the application of a lifting hook thereto and the application of a lifting force may cause the hook to damage engine components such as valve covers or the like.

Typical engines include timing marks on their rotary components as, for example, fan belt drive sheaves or flywheel, and in the case of the latter, typically an opening is provided in the flywheel housing along with a stationary index mark. The opening is covered and the cover must be removed prior to timing the engine with a strobe or the like.

In many cases, the opening is relatively inaccessible due to the proximity of the flywheel housing to a firewall or the like with the consequence that it is difficult to remove and replace the cover for the opening.

SUMMARY OF THE INVENTION

The present invention is directed to overcoming one or more of the above problems.

According to the present invention, there is provided in an engine having an elongated block terminating at one end in a flywheel housing and having a flywheel with at least one timing mark on its periphery rotatable within the housing and spaced lifting eyes secured to the engine so that the engine may be lifted from a support, an improved combination lifting eye and flywheel housing timing opening cover. The flywheel housing has an opening in its generally uppermost surface through which the timing mark may be viewed. One of the lifting eyes includes a base defining a closure for the opening, and means are provided for removably securing the base to the flywheel housing about the opening to (a) close the opening and (b) secure the lifting eye to the engine.

The construction provides a more accessible lifting eye than those in prior art, eliminates the need for separate lifting eyes and flywheel housing timing opening covers, and enables the easy removal of the closure for the timing opening.

Other objects and advantages will become apparent from the following specifications taken in connection with the accompanying drawings.

DESCRIPTION OF THE PREFERRED DEBODIMENT

Figure 1:
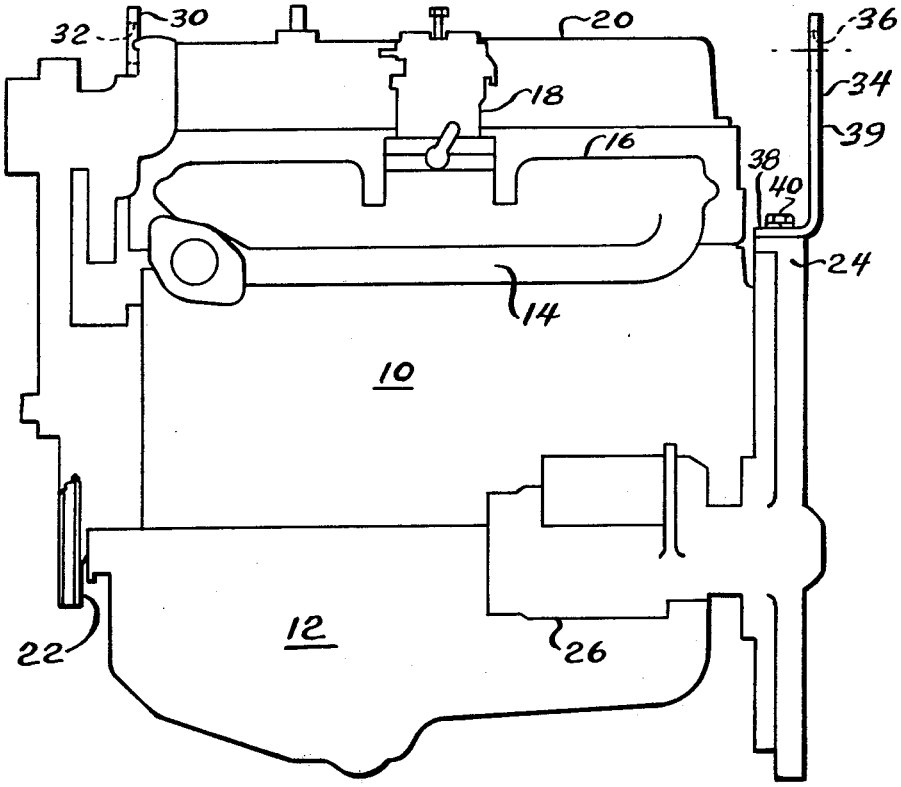
FIG. 1 is a side elevation of an engine embodying the invention.
Figure 2:
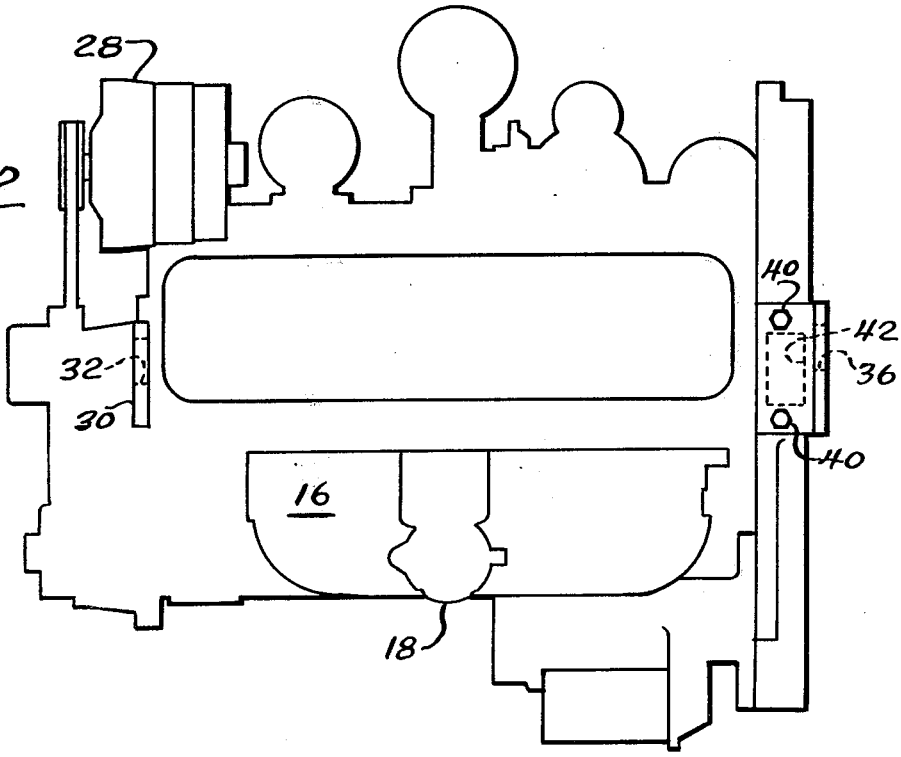
FIG. 2 is a plan view of the engine.

An exemplary embodiment of an engine made according to the invention is illustrated in FIGS. 1 and 2 in the form of a four cylinder reciprocating engine. However, it is to be understood that the invention is applicable to engines having numbers of cylinders other than four and having other than the straignt line configuration illustrated. It is also to be understood that the invention will be applicable to non-reciprocating engines such as rotary engines of the trochoidal or slant axis rotary type.

The engine includes a block 10 having a depending crank case 12. An exhaust manifold 14 is provided as is an intake manifold 16 and the latter is provided with a carburetor 18.

Valve rocker arms and the like are housed by a valve cover 20 on the head of the block. One end of the crank shaft extends forwardly of the block and mounts a fan belt drive sheave 22 while the opposite end of the block mounts a flywheel housing 24 which is secured to the block by any conventional means. A starter motor 26 is associated with the flywheel housing 24 in a conventional manner. A variety of other components such as an alternator 28 are provided in a conventional fashion and the uppermost end of the forward end of the block mounts an upwardly extending lifting eye having an aperture 32 extending therethrough for receipt of a lifting hook. It will be noted that the uppermost extent of the lifting eye 30 is not appreciably above the height of the valve cover 20 and that the same is spaced somewhat therefrom so that a hook may be easily inserted through the opening 12 without fear of damaging the valve cover 20 when a lifting force is applied.

The opposite end of the block mounts a lifting eye 34 having an opening 36 extending therethrough, also for receipt of a hook. The lifting eye 34 is in the form of an L-shaped plate having a base 38 and an upright portion 39, the latter being spaced from the block a distance approximately on the order of the width of the base 38 to ensure free accessibility to the opening 36. Again, the uppermost extent of the lifting eye 34 is not much more than the uppermost extent of the valve cover 20 to insure that the engine has a relatively low profile. As can be seen in FIG. 2, the openings 32 and 36 reside in a vertical plane which is generally parallel to the longitudinal axis of the engine, i.e., that axis defined by the crank shaft. The vertical plane extending through the openings 32 and 36 extends through the center of gravity of the engine. For the construction illustrated, the center of gravity is displaced slightly to one side of the crank shaft. Such an arrangement prevents the engine from tipping or skewing when the engine is suspended by the eyes 30 and 34.

Figure 3:
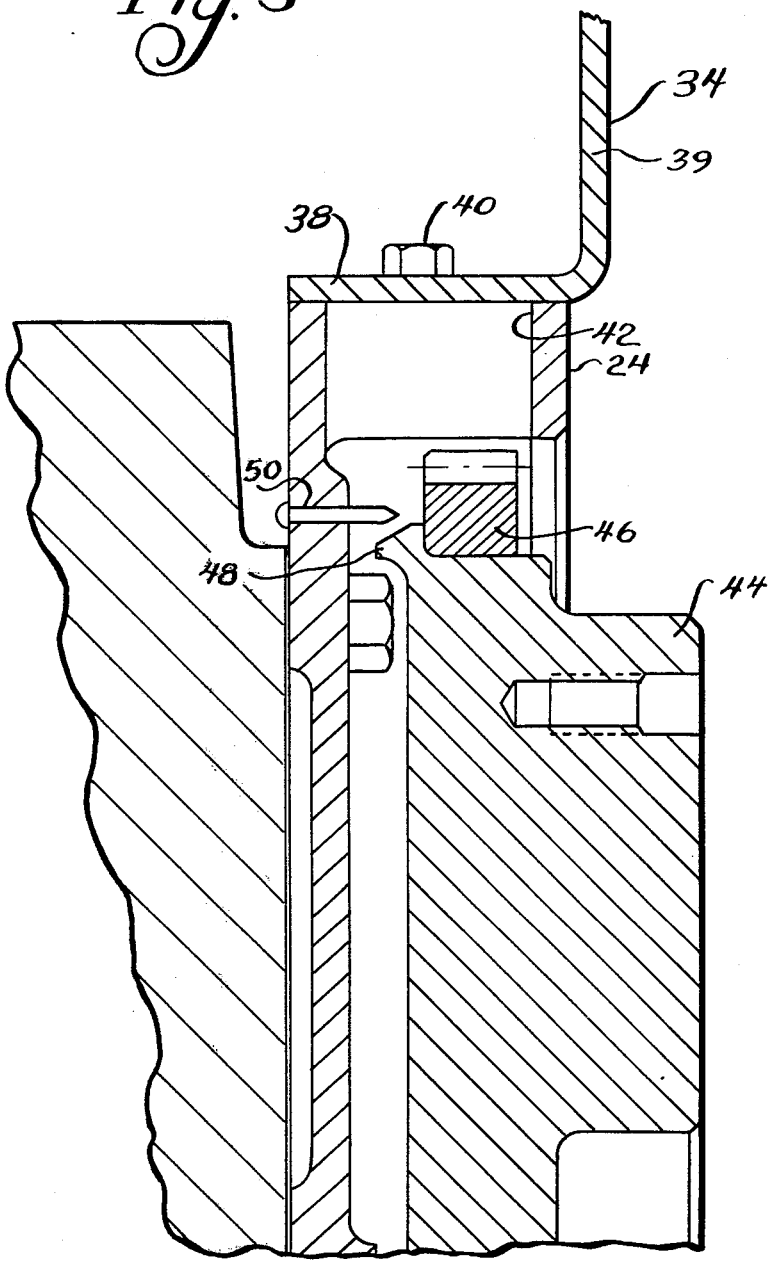
FIG. 3 is an enlarged, partial sectional view of part of the flywheel housing.

As illustrated in FIG. 1, the base 38 of the lifting eye 34 is secured as by bolts 40 to the flywheel housing 24. As seen in FIG. 3, the flywheel housing 24 terminates in an opening 42 in its uppermost surface.

United States Patent [19]

Sakakibara et al.

[11] 4,121,558

[45] Oct. 24, 1978

[54] INTERNAL COMBUSTION ENGINE ASSEMBLY

[75] Inventors: Yūji Sakakibara, Koganei; Yoshikazu Ishikawa, Chofie, both of Japan

[73] Assignee: Nissan Motor Company, Limited, Yokohama, Japan

[21] Appl. No.: 709,642

[22] Filed: Jul. 29, 1976

[30] Foreign Application Priority Data

Jul. 30, 1975 [JP] Japan ..... 50-93347

[51] Int. Cl.[2] ..... F01M 11/00; F02F 1/02

[52] U.S. Cl. ..... 123/196 R; 123/41.82 R; 123/193 H; 123/193 CH; 123/DIG. 1

[58] Field of Search ..... 123/DIG. 1, DIG. 7, 123/41.82 R, 193 CH, DIG. 6, 196 R, 52 MC, 193 H

[56] References Cited

U.S. PATENT DOCUMENTS

| | | | |
|---|---|---|---|
| 2,177,724 | 10/1939 | Kishline | 123/196 R |
| 2,179,709 | 11/1939 | Brecht | 123/DIG. 1 |
| 2,963,007 | 12/1960 | Leach | 123/DIG. 1 |
| 3,203,408 | 8/1965 | Winkelman | 123/41.82 |
| 3,352,293 | 11/1967 | Hulten | 123/196 R |
| 3,468,295 | 9/1969 | Castarede | 123/41.82 |

*Primary Examiner*—Charles J. Myhre
*Assistant Examiner*—Andrew M. Dolinar
*Attorney, Agent, or Firm*—Lowe, King, Price & Becker

[57] ABSTRACT

An assembly comprises a cylinder block and a cylinder head secured to the cylinder block to close a plurality of cylinders formed in the cylinder block and to form a cooling liquid passage, in which, in assembly, cylinder head has two assembled positions on the cylinder block, the two assembled positions being pivoted from each other.

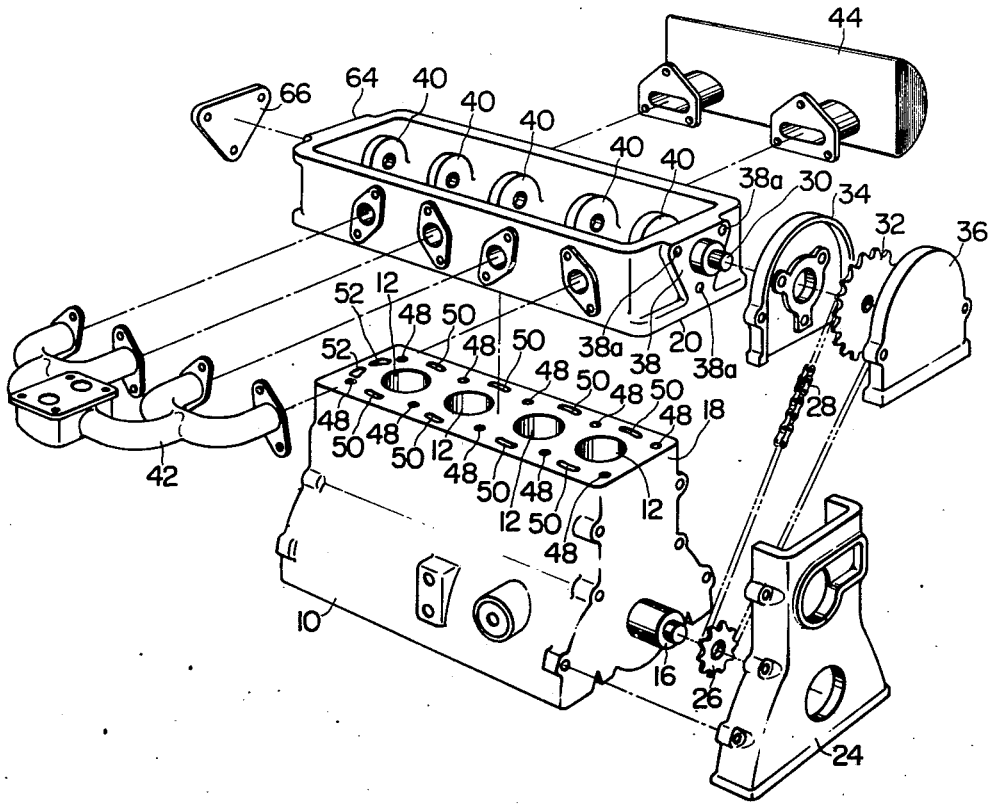

2 Claims, 7 Drawing Figures